US005397223A

United States Patent [19]

Spinnler et al.

[11] Patent Number: 5,397,223

[45] Date of Patent: Mar. 14, 1995

[54] POSITIVE-DISPLACEMENT MACHINE OPERATING BY THE SPIRAL PRINCIPLE

[75] Inventors: Fritz Spinnler, Mellingen; Roland Kolb, Regensdorf, both of Switzerland

[73] Assignee: Aginfor AG fur Industrielle Forschung, Wettingen, Switzerland

[21] Appl. No.: 183,430

[22] Filed: Jan. 19, 1994

[30] Foreign Application Priority Data

Jan. 19, 1993 [CH] Switzerland ..... 00165/93

[51] Int. Cl.[6] ..... F04C 29/02

[52] U.S. Cl. ..... 418/55.6; 418/94; 184/5; 184/6.5; 184/11.2; 184/100

[58] Field of Search ..... 184/5, 6.5, 6.16, 11.2, 184/100; 418/55.6, 94

[56] References Cited

U.S. PATENT DOCUMENTS 3,989,422 11/1976 Guttinger .
4,850,827 7/1989 Eiermann ..... 418/94
5,024,589 6/1991 Jetzer et al. ..... 418/55.6
5,318,425 6/1994 Setzer et al. ..... 418/55.6

FOREIGN PATENT DOCUMENTS 0354342 2/1990 European Pat. Off. .
3320086 12/1984 Germany .
0496230 11/1938 United Kingdom ..... 184/6.5

*Primary Examiner*—Edward K. Look
*Assistant Examiner*—Christopher Verdier
*Attorney, Agent, or Firm*—Burns, Doane, Swecker & Mathis

[57] ABSTRACT

A positive-displacement machine for compressible media has a positive displacement body that is retained on a disk-like rotor, which is eccentrically drivable relative to the housing, in such a manner that each of its points executes a circular motion during operation. To that end, an eccentric disk is disposed on a drive shaft, and the rotor is supported on this disk by means of an oil-lubricated bearing. The lubricating oil is delivered and removed to and from the side remote from the drive side of the drive shaft, and the separation of the oil inflow from the oil return flow is effected in the housing by a slide bearing which has one oil chamber each on both ends. The separation of the oil streams is effected by an indentation that does not extend over the entire length of the slide bearing. Through this indentation, the slide bearing is likewise supplied with oil. The indentation connects the oil inflow bore in the housing with the oil chamber.

3 Claims, 2 Drawing Sheets

POSITIVE-DISPLACEMENT MACHINE OPERATING BY THE SPIRAL PRINCIPLE

FIELD OF THE INVENTION

The invention relates to positive-displacement machines for compressible media that have a plurality of spiral feed chambers, disposed in a stationary housing, and a positive displacement body, associated with the feed chambers, that is retained on a rotor, and to lubricating oil systems for such machines.

BACKGROUND OF THE INVENTION

The typical structure and operation of positive-displacement machines of the spiral type are known for instance from German Patent Disclosure DE-C3-2 603 462. A compressor designed on this principle is distinguished by virtually pulsation-free feeding of the gaseous operating medium, which comprises air or an air-fuel mixture, for instance, and could therefore advantageously be used for supercharging internal combustion engines, among other purposes. During operation of this kind of compressor, a plurality of approximately crescent-shaped work chambers are enclosed along the positive displacement chamber between the spiral positive displacement body and the two peripheral walls of the positive displacement chamber; as these crescent-shaped work chambers move from the inlet through the positive displacement toward the outlet, their volume decreases continuously and the pressure of the operating medium increases accordingly.

A machine of the type described at the outset is known from European Patent Disclosure EP 0 354 342. In that machine, and in all the other known spiral compressors, in which a guide shaft operating in angular synchronism with the drive shaft is provided for the sake of translational guidance of the rotor, the bearing of the drive shaft is achieved with roller bearings. This can be seen especially clearly in the positive-displacement machine of EP 0 354 342, in which the drive shaft is supported in the housing in two ball bearings, and the eccentric collar disposed on the drive shaft is supported via a needle bearing.

This type of support of the rotor on the eccentric disk, because of the heavy centrifugal load and the eccentric motion, requires oil lubrication of the eccentric bearing, the oil being delivered to the bearing via a system of bores in the drive shaft. One such bore system is described in German Patent Disclosure DE 33 20 086 A1.

OBJECT AND SUMMARY OF THE INVENTION

The number of shaft sealing points necessary for the oil is dictated by the number of bearing points and the number of housing or rotor ducts through the drive shaft. An oil supply of the kind described in DE 33 20 086 A1 requires five shaft sealing rings to seal off the drive shaft. Shaft sealing rings must be considered weak points of the machine, and their number should be reduced to the absolute minimum that is necessary. It is therefore the object of the invention to define an oil supply that reduces the number of shaft sealing rings to the absolute minimum necessary.

The only bearing of the spiral machine, which as described at the outset requires oil lubrication because of the heavy load and the influence of centrifugal force, is the eccentric bearing of the rotor, the so-called main eccentric bearing. The rotor is pierced by the drive shaft, so that two sealing points exist for it. In order to minimize the number of points that have to be sealed off, the lubricating oil must be delivered to and removed from the eccentric disk of the drive shaft from one side. In principle, there are two possible options: The oil is carried to and away from the drive side or to and away from the air side of the housing. The housing is pierced on the drive side by the drive shaft, and as a result there would be two further points that would have to be sealed off by shaft sealing rings if the main eccentric bearing were supplied with the lubricating oil from that side. If the main eccentric bearing is supplied from the feed or air side of the machine, then only one additional shaft sealing point is necessary, since the drive shaft does not penetrate the machine on the feed side. Hence the absolute minimum number of shaft sealing rings required is three.

It is a further object of the invention to define an extremely simple, economical embodiment of the oil supply in the shaft. DE 33 20 086 A1 suggests an oil supply with delivery and removal on one side. The object of separating the oil streams, however, is shown only in the region of the shaft but not in the region of the shaft/housing interface. Moreover, this published German patent application intends the suggested embodiment for situations in which the drive shaft is supported floatingly in the housing on only one end. In such an embodiment, the number of shaft sealing rings required can be reduced to less than four only under certain circumstances, since with the floating support the housing must be pierced at the bearing point, because the drive belt disk has to be received outside the housing.

It is accordingly an additional object of the invention to define the splitting of the oil streams (inflow and outflow) at the drive shaft/housing interface. This is attained by embodying the bearing of the drive shaft that is located on the air-side half of the housing as a slide bearing.

BRIEF DESCRIPTION OF THE DRAWINGS

The present invention can be further understood by reference to the following description in conjunction with the appended drawings, which schematically illustrate an exemplary embodiment of the invention. In the drawings.

DESCRIPTION OF THE PREFERRED EMBODIMENT

Figure 1:
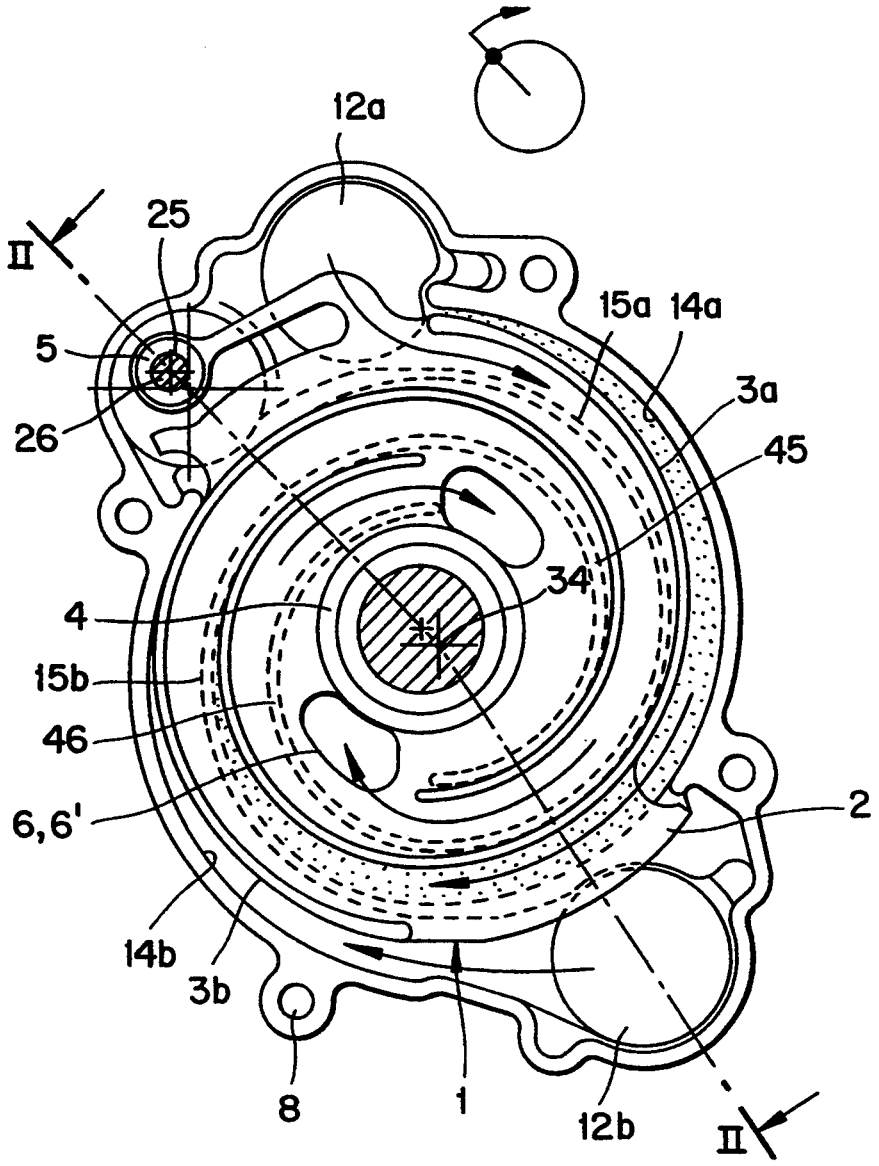
FIG. 1 is a cross section through the drive-side part of the housing of the positive-displacement machine taken along the line I—I of FIG. 2.

In FIG. 1, the housing is shown with the feed chambers and with the positive-displacement means in place. Reference numeral 1 indicates the overall rotor of the machine. On each of the two sides of the disk 2, two spirally extending positive-displacement bodies are disposed, offset by 180°. In the view of FIG. 1, these bodies are ribs 3*a*, 3*b*, which are retained vertically on the disk 2. On the opposing side of the disk 2, ribs 45, 46 are disposed. The spirals themselves, in the example shown, are formed of a plurality of circular arcs adjoining one another. Reference numeral 4 indicates the hub with which the disk 2 is supported above the bearing 22 on an eccentric disk 23. This eccentric disk is in turn part of the drive shaft 24.

Reference numeral 5 indicates an eyelet, disposed radially outside the beads 3*a*, 3*b*, for receiving a guide bearing 25 that is slip-mounted onto an eccentric bolt 26. This bolt is in turn part of a guide shaft 27. Four passageway windows 6, 6' are provided on the spiral and in the disk 2 so that the medium can pass from one side of the disk to the other, for example, in order to be removed into a central outlet disposed on only one side.

Figure 2:
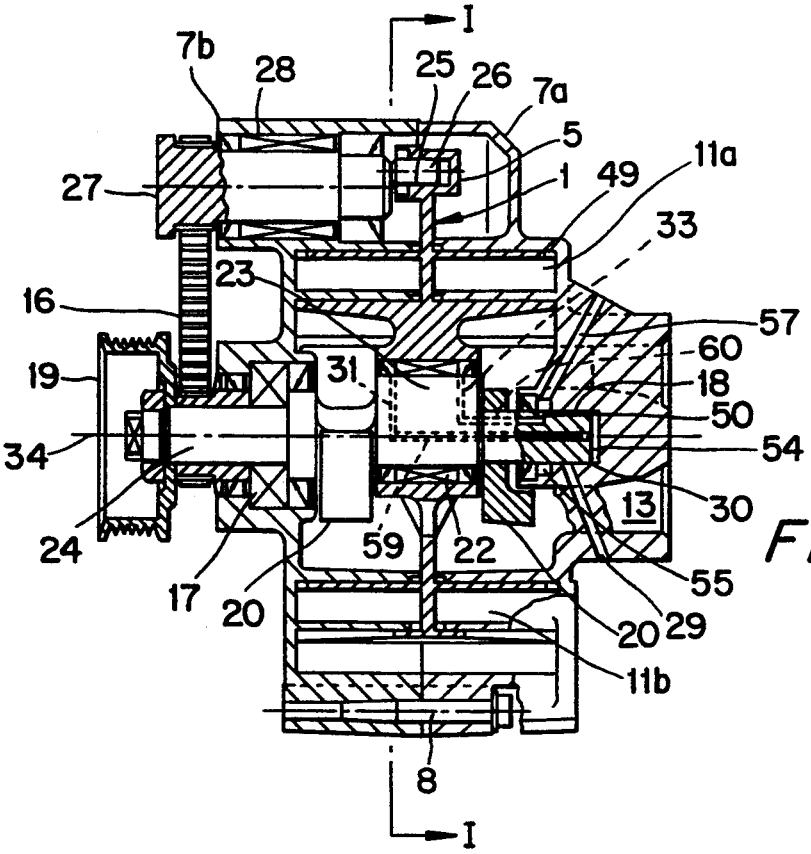
FIG. 2 is a longitudinal section through the positive displacement machine along the line II—II of FIG. 1, with lubricant bores drawn schematically; and, FIG. 3 is a longitudinal section through the drive shaft.

In FIG. 1, the housing half 7*a*, shown on the right in FIG. 2, of the machine housing composed of two halves 7*a*, 7*b* is shown; these halves are connected to one another via fastening eyelets 8 for receiving screw fasteners. Reference numerals 11*a* and 11*b* indicate the feed chambers, each offset from one another by 180°, which are machined in the manner of a spiral slit into the two housing halves. They each extend from a respective inlet 12*a*, 12*b*, disposed on the outer circumference of the spirals in the housing, to an outlet 13 (FIG. 2) provided in the interior of the housing and common to both feed chambers. They have substantially parallel cylinder walls 14*a*, 14*b*, 15*a*, 15*b*, disposed at a constant distance from one another, which in the present case, like the positive-displacement bodies of the disk 2, encompass a spiral of approximately 360°.

The positive-displacement bodies 3*a*, 3*b* engage between these cylinder walls, and the curvature of these bodies is such that the ribs 3*a*, 3*b* nearly touch the inner and outer cylinder walls of the housing at a plurality of points, for instance at two points. Seals are placed in corresponding grooves on the free face ends of the ribs 3*a*, 3*b* and of the ribs 45, 46. With these seals, the work chambers are sealed off from the side walls of the housing and from the positive-displacement disk, respectively.

The drive and guidance of the rotor 1 are provided by the two spaced-apart eccentric arrangements 23, 24 and 26, 27, respectively. The drive shaft 24 is support on the drive side in a roller bearing 17 and on the air side in a slide bearing 18. At its end protruding out of the housing half 7*b*, it is provided with a V-belt disk 19 for the drive mechanism. Counterweights 20 are disposed on the drive shaft 24 in order to compensate for the forces of mass that arise when the rotor is driven eccentrically. The guide shaft 27 is supported inside the housing half 7*b* by means of a roller bearing 28. To attain unequivocal guidance of the rotor 1 at the dead center positions, the two eccentric arrangements are angularly accurately synchronized via a toothed belt drive 16. This dual eccentric drive assures that all the points of the rotor disk, and hence all the points of the two ribs 3*a* and 3*b*, will execute a circular displacement motion. Because the approaches of the ribs 3*a*, 3*b* to the inner and outer cylinder walls of the associated feed chambers alternate repeatedly, crescent-shaped work chambers enclosing the operating medium are created on both sides of the rib. During the drive of the rotor disk, these chambers are displaced through the feed chambers in the direction of the outlet. In the process, the volumes of these work chambers decrease and the pressure of the operating medium is correspondingly increased.

Figure 3:
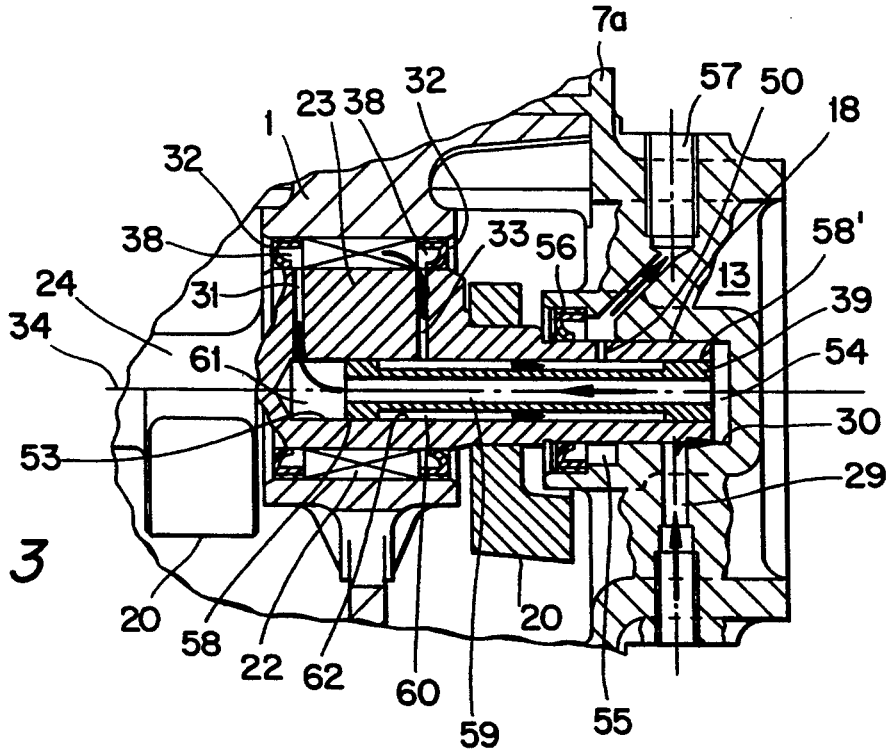

In FIG. 3, the bearings 18 and 22 are shown. They need to be supplied with oil. From a lubricant source, not shown, lubricant, preferably oil, is carried to the slide bearing 18 via a bore 29 in the housing half 7*a*. The fresh oil reaches the oil chamber 54 through an indentation 30 in the slide bearing 18. The indentation 30 is open with respect to the drive shaft 24 and supplies the slide bearing 18 with oil. At the same time, the indentation 30 brings about the throttling and quantity control of the oil fed into the bore 29 under pressure.

A longitudinal bore 53 is made in the drive shaft 24, and in it the oil guide sleeve 39 is retained at the points 58, 58', for instance by means of a press fit in the drive shaft 24. The sleeve itself is tapered in its external diameter in its middle portion 62, as a result of which a second oil conduit 60 that is separated from the first oil conduit 59 is formed in an extremely simple way. The oil flowing into the oil chamber 54 through the indentation in the slide bearing 18 can reach the oil chamber 61, formed by the longitudinal bore 53 in the drive shaft 24, through the central bore 59 located in the sleeve 39; from this oil chamber 61, the oil can reach the bearing 22 through the radial bore 31.

The oil flows into the oil chambers 38 of the rotor 1 and is sealed off from the outlet 13 by the shaft sealing rings 32. The return flow of oil out of the bearing 22 takes place through the radial bore 33, which connects the one oil chamber 38 with the oil conduit 60. The returning oil passes through the radial bore 50 into the oil chamber 55, which communicates with the bore 57 in the housing 7*a*. The oil chamber is sealed off from the outlet 13 carrying the operating medium by the shaft sealing ring 56.

What is claimed is:

1. A lubricating system for a positive-displacement machine for compressible media having a plurality of spiral feed chambers disposed in a stationary housing, and having a positive-displacement body assigned to the feed chambers, which body is retained in such a way on a disk-like rotor that is eccentrically driveable relative to the housing that during operation, each point of the positive displacement body executes a circular motion defined by peripheral walls of the feed chambers, comprising: an eccentric disk disposed on a drive shaft, on which disk the rotor is supported by means of an oil-lubricated bearing, wherein lubricating oil is delivered and removed in a side remote from a drive side of the drive shaft, and separation of an oil inflow from an oil return flow in the housing is effected by a slide bearing which has one oil chamber on each of its two ends.

2. The lubricating system for a positive-displacement machine according to claim 1, wherein the separation of the lubricating oil inflow and return flow is effected by an indentation that does not extend over the entire length of the slide bearing, and that by this indentation, the slide bearing is likewise supplied with oil, wherein the indentation connects an oil inflow bore in the housing with the oil chamber.

3. The lubricating system for a positive-displacement machine according to claim 2, wherein the splitting of the lubricating oil streams in the drive shaft is effected by means of a rotationally symmetrical sleeve, press-fitted into a longitudinal bore and having a tapered middle portion, wherein the press fits of the sleeve are located at its ends, and as a result two coaxial oil conduits are formed in the drive shaft, which are dimensioned in their length such that radial bores for supplying the bearing discharge into their respective conduits.

* * * * *